US010281855B2

(12) United States Patent
Oonishi et al.

(10) Patent No.: US 10,281,855 B2
(45) Date of Patent: May 7, 2019

(54) IMAGE FORMING APPARATUS FOR STARTING IMAGE FORMATION WITH A REDUCED WAITING TIME

(71) Applicant: Konica Minolta, Inc., Chiyoda-ku, Tokyo (JP)

(72) Inventors: Taizou Oonishi, Hachioji (JP); Toru Komatsu, Tachikawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/627,504

(22) Filed: Jun. 20, 2017

(65) Prior Publication Data

US 2017/0371277 A1 Dec. 28, 2017

(30) Foreign Application Priority Data

Jun. 22, 2016 (JP) ..... 2016-123135

(51) Int. Cl.
*G03G 15/20* (2006.01)
*G03G 15/00* (2006.01)

(52) U.S. Cl.
CPC ..... *G03G 15/205* (2013.01); *G03G 15/2017* (2013.01); *G03G 15/5029* (2013.01); *G03G 15/2021* (2013.01); *G03G 2215/2006* (2013.01)

(58) Field of Classification Search
CPC ..... G03G 15/205; G03G 15/2017; G03G 15/2021; G03G 15/2078; G03G 15/2089; G03G 2215/2006; G03G 15/5029
See application file for complete search history.

(56) References Cited

U.S. PATENT DOCUMENTS

2008/0267644 A1* 10/2008 Murakami ..... G03G 15/6508 399/45
2013/0164015 A1* 6/2013 Kawai ..... G03G 15/2039 399/69

FOREIGN PATENT DOCUMENTS

JP 2006-30823 A 2/2006
JP 2006-133310 A 5/2006

* cited by examiner

*Primary Examiner* — Joseph S Wong

(74) *Attorney, Agent, or Firm* — Buchanan Ingersoll & Rooney PC

(57) ABSTRACT

An image forming apparatus includes an image fixing unit to pass a sheet carrying an unfixed toner image on a first side. The image fixing unit includes: a first fixing section adjacent to the first side of the sheet; a first heating section to heat the first fixing section; a second fixing section adjacent to a second side opposite to the first side of the sheet; and a second heating section to heat the second fixing section. The image forming apparatus further includes: sheet feeding trays holding sheets; a storage unit storing fixing temperatures of the fixing sections preset for each type of the sheets in the sheet feeding trays; and a controller to select standby temperatures from the fixing temperatures, based on temperature profiles of the fixing sections, and to instruct the heating sections to respectively maintain the fixing sections at the selected standby temperatures during a standby mode.

14 Claims, 5 Drawing Sheets

| | TRAY 1 | TRAY 2 | TRAY 3 |
|---|---|---|---|
| TYPE OF SHEET | PLAIN | COLORED | COATED |
| BASIS WEIGHT ($g/m^2$) | 62−74 | 106−135 | 177−216 |
| UPPER-SIDE FIXING TEMPERATURE | 148 | 182 | 192 |
| LOWER-SIDE FIXING TEMPERATURE | 140 | 95 | 70 |

| | TRAY 1 | TRAY 2 | TRAY 3 |
|---|---|---|---|
| TYPE OF SHEET | PLAIN | COLORED | COATED |
| BASIS WEIGHT ($g/m^2$) | 62−74 | 106−135 | 177−216 |
| UPPER-SIDE FIXING TEMPERATURE | 148 | 182 | 192 |
| LOWER-SIDE FIXING TEMPERATURE | 140 | 95 | 70 |

IMAGE FORMING APPARATUS FOR STARTING IMAGE FORMATION WITH A REDUCED WAITING TIME

BACKGROUND OF THE INVENTION

Field of the Invention

The present invention relates to image forming apparatuses.

Description of Related Art

Formation of an electrostatic latent image with a typical electrophotographic image forming apparatus involves charging an image carrier, such as a photoconductive drum, to a predetermined potential and performing imagewize exposure on the image carrier to form a latent image. The latent image on the photoconductive drum is developed with a developing unit with a developer (toner), and is visualized into a toner image which is then transferred on a sheet. The sheet carrying the toner image thereon is transferred to a fixing unit, and the toner image on the sheet is fixed with the fixing unit into a printed image on the sheet.

The fixing unit of the image forming apparatus has a nip. While the sheet is passing through the nip, the unfixed toner image on the sheet is heated under pressure. The unfixed toner is thereby melt and fixed on the sheet.

Different types of sheets require different temperatures to fix the toner image on the sheets. Accordingly, several techniques for controlling the temperature of the fixing unit have been proposed. For example, Japanese Patent Application Laid-Open Publication No. 2006-133310 discloses varying the temperature of the fixing unit in response to detection of the type of the sheet when a sheet feeding cassette is attached. Japanese Patent Application Laid-Open Publication No. 2006-030823 discloses maintaining the fixing unit at a fixing temperature preset for the most frequently used feeding cassette (the most frequently used sheet) during a standby mode.

Unfortunately, the techniques disclosed in Japanese Patent Application Laid-Open Publication Nos. 2006-133310 and 2006-030823 cannot certainly specify the sheet (sheet feeding cassette) to be used for the next image formation. In response to an instruction of the image formation on a sheet different from the preset sheets, these traditional techniques disadvantageously cause a waiting time required for adjustment of the fixing temperature to an appropriate temperature, leading to reduced productivity.

SUMMARY OF THE INVENTION

An object of the present invention, which has been made in view of the problem, is to provide an image forming apparatus that can start the image formation with a reduced waiting time.

In order to realize the above object, according to a first aspect of the present invention, there is provided an image forming apparatus including:

an image fixing unit to pass a sheet carrying an unfixed toner image on a first side through a fixing nip to fix the unfixed toner image on the sheet, the image fixing unit including:

a first fixing section disposed to be adjacent to the first side of the sheet;

a first heating section to heat the first fixing section;

a second fixing section disposed to be adjacent to a second side opposite to the first side of the sheet; and a second heating section to heat the second fixing section;

a plurality of sheet feeding trays holding sheets;

a storage unit storing fixing temperatures of the first fixing section and the second fixing section, the fixing temperatures being preset for each type of the sheets in the sheet feeding trays; and a controller to select standby temperatures of the first fixing section and the second fixing section from the fixing temperatures preset for each type of the sheets and stored in the storage unit, based on temperature profiles of the first fixing section and the second fixing section, and to instruct the first heating section and the second heating section to respectively maintain the first fixing section and the second fixing section at the selected standby temperatures during a standby mode before image formation.

Preferably, in the above image forming apparatus, the controller selects a maximum fixing temperature as the standby temperature of one of the first fixing section and the second fixing section that has a relatively high cooling rate, and a minimum fixing temperature as the standby temperature of the other fixing section, from the fixing temperatures preset for each type of the sheets and stored in the storage unit.

Preferably, in the above image forming apparatus, the first fixing section includes a belt member and a cooling mechanism to cool the belt member, the second fixing section includes a rotary member covered with an elastic material, and the controller selects a maximum fixing temperature as the standby temperature of the first fixing section and a minimum fixing temperature as the standby temperature of the second fixing section, from the fixing temperatures preset for each type of the sheets and stored in the storage unit.

Preferably, in the above image forming apparatus, the controller selects a minimum fixing temperature as the standby temperature of one of the first fixing section and the second fixing section that has a relatively high heating rate, and a maximum fixing temperature as the standby temperature of the other fixing section, from the fixing temperatures preset for each type of the sheets and stored in the storage unit.

Preferably, in the above image forming apparatus, the first fixing section includes a belt member, the second fixing section includes a rotary member covered with an elastic material, the first heating section consumes greater electric power than the second heating section, and the controller selects a minimum fixing temperature as the standby temperature of the first fixing section, and a maximum fixing temperature as the standby temperature of the second fixing section, from the fixing temperatures preset for each type of the sheets and stored in the storage unit.

Preferably, in the above image forming apparatus, in the case that a heating rate is higher than a cooling rate in both the first fixing section and the second fixing section, the controller selects minimum fixing temperatures as the standby temperatures of the first fixing section and the second fixing section, from the fixing temperatures preset for each type of the sheets and stored in the storage unit.

Preferably, in the above image forming apparatus, in the case that a cooling rate is higher than a heating rate in both the first fixing section and the second fixing section, the controller selects maximum fixing temperatures as the standby temperatures of the first fixing section and the second fixing section, from the fixing temperatures preset for each type of the sheets and stored in the storage unit.

Preferably, in the above image forming apparatus, in the case that a cooling rate is comparable with a heating rate in both the first fixing section and the second fixing section, the controller defines mean temperatures of the fixing temperatures preset for all the types of the sheets and stored in the storage unit as the standby temperatures of the first fixing section and the second fixing section.

Preferably, in the above image forming apparatus, the temperature profiles are determined in the state where the first fixing section is separated from the second fixing section.

Preferably, in the above image forming apparatus, the controller modifies the temperature profiles depending on a warm-up state or an environmental condition of the image forming apparatus.

Preferably, the above image forming apparatus further includes:

a correspondence information storage preliminary storing a correlation between the type of sheets and the fixing temperatures of the first fixing section and the second fixing section; and detectors to detect the types of sheets stocked in the sheet feeding trays, wherein in the case that a sheet detected at any of the detectors differs in type from the sheets stocked in the sheet feeding trays, the controller overwrites the fixing temperatures stored in the storage unit with the fixing temperatures stored in the correspondence information storage.

Preferably, in the above image forming apparatus, the controller updates the standby temperatures at predetermined time intervals before image formation or in response to a request signal.

Preferably, in the above image forming apparatus, in the case that any image processing operation other than temperature control of the image fixing section is scheduled at the start of the image formation, the controller controls the temperature of the image fixing unit after the image processing operation.

Preferably, the above image forming apparatus further includes:

a sheet proportion storage which stores an accumulated proportion of different types of sheets used for past image formation, wherein the controller allows the fixing temperatures preset for each type of the sheets and stored in the storage unit to be weighted with the accumulated proportion stored in the sheet proportion storage.

BRIEF DESCRIPTION OF THE DRAWINGS

The present invention shall be completely understood with reference to the following description and the accompanying drawings. The following description and the drawings should not be construed to limit the present invention.

PREFERRED EMBODIMENT OF THE INVENTION

Figure 1:
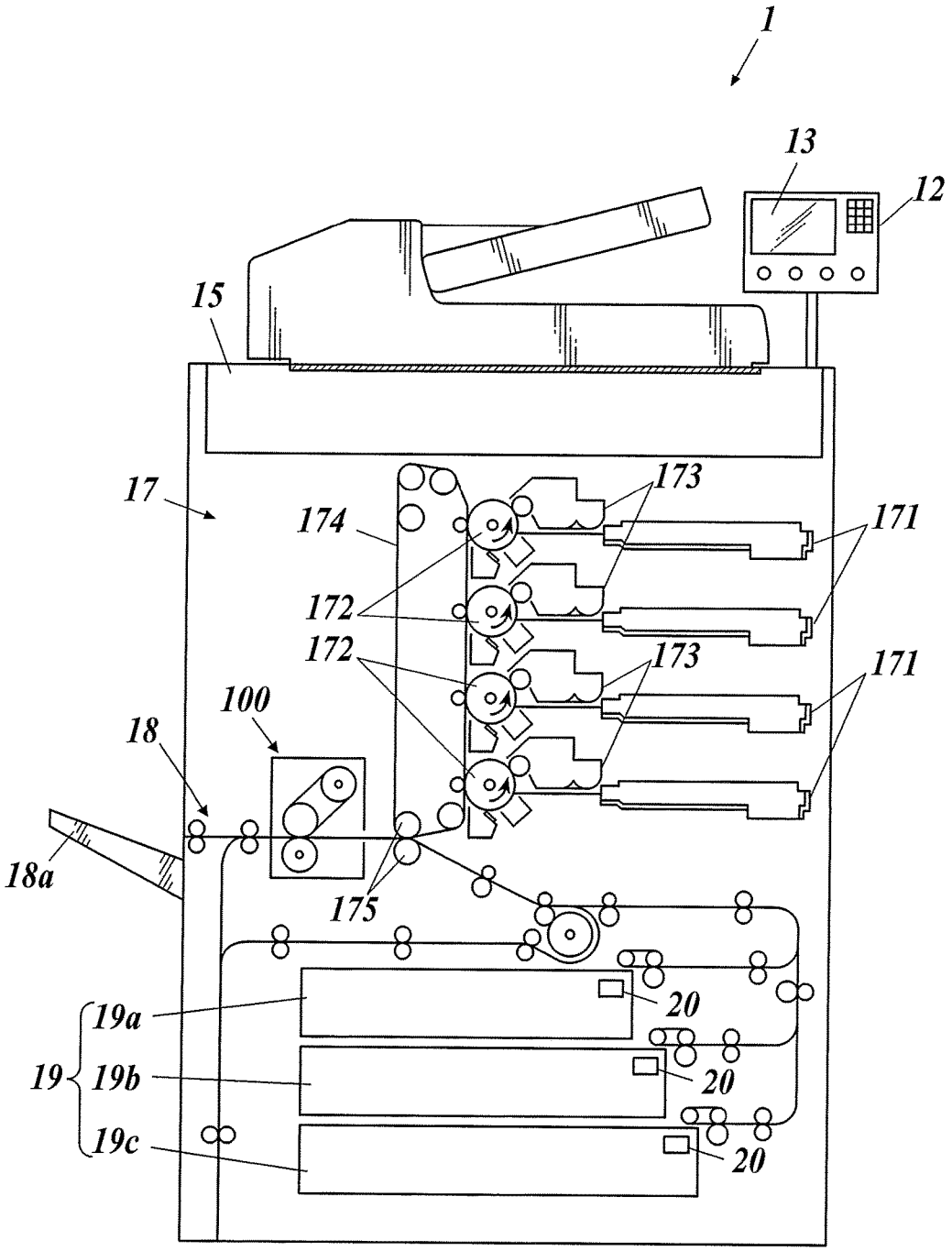
FIG. 1 is a schematic configurational view of an image forming apparatus according to an embodiment of the present invention.

Embodiments of the present invention will now be described with reference to the accompanying drawings. It is noted that the scope of the present invention should not be limited to the examples illustrated in the drawings.

The configuration of an image forming apparatus according to an embodiment of the present invention will now be described.

Figure 2:
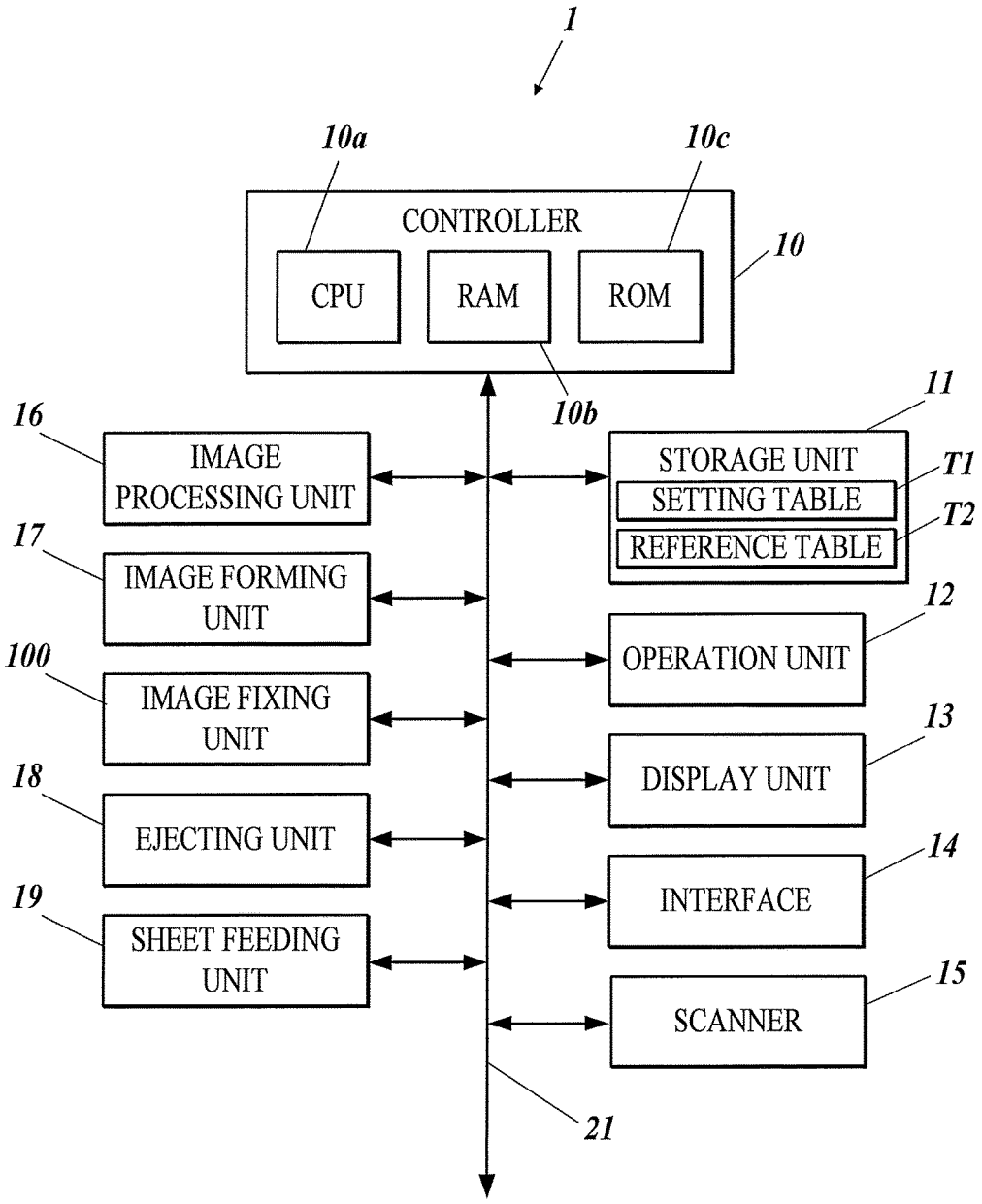
FIG. 2 is a block diagram illustrating the main functional configuration of the image forming apparatus of FIG. 1.

FIG. 1 is a schematic view of the image forming apparatus 1 according to the embodiment. FIG. 2 is a block diagram illustrating the main functional configuration of the image forming apparatus 1.

With reference to FIGS. 1 and 2, the image forming apparatus 1 includes a controller 10 including a central processing unit (CPU) 10*a*, a random access memory (RAM) 10*b*, and a read only memory (ROM) 10*c*, a storage unit 11, an operation unit 12, a display unit 13, an interface 14, a scanner 15, an image processing unit 16, an image forming unit 17, an image fixing unit 100, a ejecting unit 18, and a sheet feeding unit 19. The controller 10 is connected via a bus 21 to the storage unit 11, the operation unit 12, the display unit 13, the interface 14, the scanner 15, the image processing unit 16, the image forming unit 17, the image fixing unit 100, the ejecting unit 18, and the sheet feeding unit 19.

The CPU 10*a* runs control programs stored in the ROM 10*c* or the storage unit 11 to carry out various operations.

The RAM 10*b* serves as a working area for the operation of the CPU 10*a* and stores temporal data.

The ROM 10*c* stores programs for various control to be executed by the CPU 10*a* and setting data. The ROM 10*c* may be replaced with a rewritable nonvolatile memory, such as an electrically erasable programmable read only memory (EEPROM) and a flash memory.

The controller 10, which includes the CPU 10*a*, the RAM 10*b*, and the ROM 10*c*, comprehensively controls the components of the image forming apparatus 1 in accordance with the various control programs described above. For example, the controller 10 instructs the image processing unit 16 to execute a predetermined image processing operation on image data and the storage unit 11 to store the processed image data. The controller 10 also instructs the image forming unit 17 to form a toner image corresponding to the image data stored in the storage unit 11 and the image fixing unit 100 to fix the toner image on a sheet.

The storage unit 11 is composed of a semiconductor memory, such as a dynamic random access memory (DRAM) or a hard disk drive (HDD), and stores image data received from the scanner 15 or an external device through the interface 14. The image data may be stored in the RAM 10*b*.

The operation unit 12 is provided with an input device, such as operational keys or a touch panel overlaid on the screen of the display unit 13. The operation unit 12 converts input operations on the input device into operational signals which are transmitted to the controller 10.

The display unit 13 includes a display, such as a liquid crystal display (LCD), that presents an operation screen indicating the state of the image forming apparatus 1 and the content of the input operations on the touch panel.

The interface 14 sends and receives data to/from an external computer and another image forming apparatus. The interface 14 may be any of serial interfaces.

The scanner 15 scans the image on a sheet, generates image data including monochromatic image data components (red (R), green (G), and blue (B) components), and instructs the storage unit 11 to store the image data.

The image processing unit 16 includes a rasterizing processor, a color converter, a gradation corrector, and a halftone processor, for example. The image processing unit 16 executes various image processing operations on the image data stored in the storage unit 11, and instructs the storage unit 11 to store the processed image data.

The image forming unit 17 forms an image corresponding to the image data stored in the storage unit 11 on a sheet. The image forming unit 17 includes four exposure sections 171, four photoreceptors 172, and four developing sections 173 respectively for four color components; cyan (C), magenta (M), yellow (Y), and black (K). The image forming unit 17 also includes a transfer unit 174 and secondary transfer rollers 175.

Each exposure section 171 includes a laser diode (LD) as a light-emitting device. Each of the exposure sections 171 drives the corresponding LD based on the image data, irradiates the corresponding charged photoreceptor 172 with a laser beam to expose the photoreceptor 172, and forms an electrostatic latent image on the photoreceptor 172. Each of the developing sections 173 feeds a predetermined coloring material (toner in C, M, Y, or K) on the exposed photoreceptor 172 with a charged developing roller, and develops the electrostatic latent image formed on the photoreceptor 172.

The monochromatic images formed with the C, M, Y, and K toners on the respective photoreceptors 172 are sequentially overlaid from the photoreceptors 172 to the transfer unit 174, forming a color image including the C, M, Y, and K color components on the transfer unit 174. The transfer unit 174 is an endless belt wound around transfer rollers, and is circulated by the rotation of the transfer rollers.

The secondary transfer rollers 175 transfer the color image on the transfer unit 174 to the sheet fed from the sheet feeding unit 19 or an external feeding device. In detail, a predetermined voltage is applied to the secondary transfer rollers 175 holding the sheet and the transfer unit 174 therebetween, so that the toners forming the color image on the transfer unit 174 are attracted to and transferred on the sheet.

The image fixing unit 100 applies heat and pressure to the sheet carrying the toners thereon to fix the toner image on the sheet. The detailed configuration of the image fixing unit 100 will be described later.

The ejecting unit 18 includes ejecting rollers that hold the sheet carrying the toner image fixed by the image fixing unit 100 and eject the sheet to the sheet receiving tray 18*a* through a ejecting port.

The sheet feeding unit 19 includes a stack of sheet feeding trays 19*a* to 19*c* and a sheet feeding mechanism.

Each of the sheet feeding trays 19*a* to 19*c* hold different types of sheets specified by the basis weight and size.

The sheets stocked in the sheet feeding trays 19*a* to 19*c* are transferred one by one from the uppermost sheet with the sheet feeding mechanism.

Figures 3, 4:
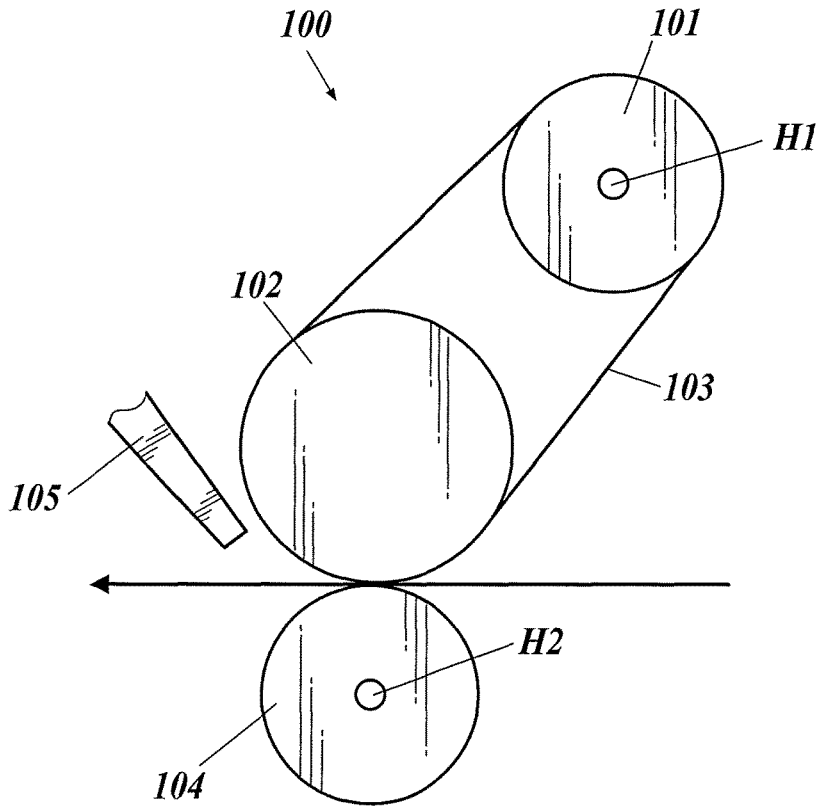
FIG. 3 is a schematic view of an image fixing unit.
FIG. 4 is an exemplary setting table.

FIG. 3 is a schematic configurational view of the image fixing unit 100.

The image fixing unit 100 allows the sheet carrying the unfixed toner image thereon to pass through a fixing nip, and the toner image is thereby fixed on the sheet.

The image fixing unit 100 includes a heating roller 101, a fixing roller 102, a fixing belt (belt member) 103, a pressure roller (rotary member) 104, and a cooling mechanism 105.

The heating roller 101, the fixing roller 102, the fixing belt 103, and the cooling mechanism 105 are disposed adjacent to a first or upper side with the unfixed toner image of the sheet. The pressure roller 104 is disposed adjacent to a second or lower side of the sheet opposite to the first side.

The fixing roller 102, the fixing belt 103, and the cooling mechanism 105 constitute a first fixing section, and the heating roller 101 constitutes a first heating section. The pressure roller 104 constitutes a second fixing section and a second heating section.

The heating roller 101 accommodates a halogen heater H1 for heating the fixing belt 103. The heating roller 101 is a hard roller that includes a hollow rotary aluminum cylinder and is covered with a thermally resistant perfluoroalkoxy (PFA) tube, for example.

In response to an instruction from the controller 10, the halogen heater H1 turns on to heat the fixing roller 102 to a predetermined temperature.

The fixing roller 102 is a soft roller that includes a solid metal core composed of iron and covered with a thermally resistant silicone rubber, which is covered with sponge.

The fixing belt 103 is rotatably supported by the heating roller 101 and the fixing roller 102.

The fixing belt 103 is of an endless type that has a base made of a thermally resistant resin, such as polyimide (PI). The base of the fixing belt 103 is covered with a thermally resistant silicone rubber, which is covered with a releasable layer composed of a PFA tube, for example.

The pressure roller 104 accommodates a halogen heater H2. The pressure roller 104 is composed of a cylindrical metal core made of a stainless steel, an elastic layer (elastic material) made of a silicone rubber foam and disposed around the metal core, and a releasable layer made of a PFA tube and covering the elastic layer.

In response to an instruction from the controller 10, the halogen heater H2 turns on to heat the pressure roller 104 to a predetermined temperature.

The pressure roller 104 also includes a pressure-contacting and separating mechanism (not shown) that can bring the pressure roller 104 into pressure contact with the fixing roller 102 with the fixing belt 103 intervening therebetween and bring the pressure roller 104 remote from the fixing roller 102.

In the image formation mode and the cooling-down mode, the pressure roller 104 is in pressure contact with the fixing roller 102 with the fixing belt 103 intervening therebetween, forming a fixing nip between the fixing roller 102 and the pressure roller 104.

In the standby mode and the warming-up mode during which the image formation is not carried out, the pressure roller 104 is separated from the fixing roller 102 to release the pressure contact therebetween.

The cooling mechanism 105 is disposed adjacent to the upper side and the ejecting side of the sheet relative to the fixing nip.

The cooling mechanism 105 is provided with a nozzle for ejecting cooling air. In response to an instruction from the controller 10, the cooling mechanism 105 turns on to eject the cooling air through the nozzle to the fixing belt 103, lowering the temperature of the fixing belt 103 (and the fixing roller 102).

The cooling mechanism 105 also can release the leading edge of the sheet wound around the fixing belt 103 by wind pressure of an air stream.

It should be noted that the cooling mechanism may have any configuration that can lower the temperature of the fixing belt 103 (and the fixing roller 102), besides the configuration described above.

In conjunction with clockwise rotation of the fixing roller 102 of the image fixing unit 100 with a driving means (not shown), the fixing belt 103 and the heating roller 101 are rotated clockwise, and the pressure roller 104 is rotated counterclockwise.

The heating roller 101, which is heated with the halogen heater H1, heats the fixing belt 103 in contact with the heating roller 101 and the fixing roller 102 supporting the fixing belt 103.

The pressure roller 104 is heated with the halogen heater H2.

In the state where the pressure roller 104 is in pressure contact with the fixing belt 103 (and the fixing roller 102), the sheet carrying the unfixed toner image thereon is transferred with the secondary transfer rollers 175 to the fixing nip between the fixing belt 103 and the pressure roller 104, and is heated under pressure at the fixing nip, so that the toner image is fixed on the sheet.

Any heating mechanism other than the halogen heaters may be used to heat the fixing belt 103; for example, an induction heater including an exciting coil may be used. The halogen heaters are not necessarily accommodated in the heating roller 101 and the pressure roller 104; the halogen heaters may be disposed at any position. More than two halogen heaters may be provided.

Temperature control of the image fixing unit 100 according to the embodiment will now be described.

According to the embodiment, the controller 10 selects an appropriate standby temperature from the fixing temperatures preset for different types of the sheets and stored in the storage unit 11, based on temperature profiles of the first fixing section (the fixing roller 102 and the fixing belt 103) and the second fixing section (the pressure roller 104). The controller 10 then instructs the first and second heating sections to respectively maintain the first and second fixing sections at the selected standby temperature during the standby mode before the image formation.

Detailed examples of the temperature control will now be described.

FIG. 4 illustrates an exemplary setting table T1 showing upper-side and lower-side fixing temperatures preset for each sheet feeding tray (three trays 19*a* to 19*c* in this embodiment) (i.e., preset for each type of the sheets stocked in the sheet feeding trays 19*a* to 19*c*) for the image formation.

In the example illustrated in FIG. 4, the sheet feeding tray 19*a* (Tray 1) holds sheets of plain paper having a basis weight of 62-74 g/m$^2$. The fixing temperature for the first or upper side of the sheet is 148° C., and that for the second or lower side of the sheet is 140° C.

The sheet feeding tray 19*b* (Tray 2) holds sheets of colored paper having a basis weight of 106-135 g/m$^2$. The fixing temperature for the first or upper side of the colored sheet is 182° C., and that for the second or lower side of the sheet is 95° C.

The sheet feeding tray 19*c* (Tray 3) holds sheets of coated paper having a basis weight of 177-216 g/m$^2$. The fixing temperature for the first or upper side of the coated sheet is 192° C., and that for the second or lower side of the sheet is 70° C.

The storage unit 11 includes a correspondence information storage that preliminarily stores a correlation reference table T2 indicating the type of sheets and the fixing temperatures of the first and second fixing sections preset for each type of the sheet. Upon selection of the type of a sheet from the sheet feeding trays 19*a* to 19*c* by a user, the basis weight, the fixing temperature for the upper side, and the fixing temperature for the lower side of the selected sheet are transferred from the reference table T2 to the setting table T1.

In this embodiment, the fixing belt 103 having small thermal capacity and the cooling mechanism 105 of the image fixing unit 100 are disposed adjacent to the first or upper side of the sheet.

In contract, the pressure roller 104 having large thermal capacity and provided with an elastic layer having low thermal conductivity is disposed adjacent to the second or lower side of the sheet.

The controller 10 accordingly determines the temperature profile of the first and second fixing sections as follows: the first or upper side of the sheet has a cooling rate higher than that of the second or lower side of the sheet.

The controller 10, therefore, allows the first fixing section adjacent to the first or upper side of the sheet to have a maximum fixing temperature "192° C.", and the second fixing section adjacent to the second or lower side of the sheet to have a minimum fixing temperature "70° C." during the standby mode.

In other words, the maximum fixing temperature is defined as standby temperatures of the fixing components (i.e., the fixing roller 102 and the fixing belt 103) disposed adjacent to the first or upper side of the sheet and having a high cooling rate.

In contrast, the minimum fixing temperature is defined as a standby temperature of the fixing component (i.e., the pressure roller 104) disposed adjacent to the second or lower side of the sheet and having a low cooling rate.

Thus, the fixing roller 102 and the fixing belt 103 that are maintained at a high temperature during the standby mode rapidly cool, whereas the pressure roller 104 maintained at a low temperature during the standby mode rapidly heats. Such a configuration can reduce the waiting time before the start of the image formation.

The temperature profiles of the first fixing section (the fixing roller 102 and the fixing belt 103) and the second fixing section (the pressure roller 104) should be preferably determined in the state where the first fixing section is separated from the second fixing section. The use of the temperature profiles determined in the state where the first fixing section and the second fixing section do not affect each other leads to more accurate temperature control.

In addition, the controller 10 should preferably update the standby temperatures at predetermined time intervals before the image formation or in response to a request signal. Such update of the standby temperatures at predetermined time intervals leads to more accurate temperature control.

As described above, the image forming apparatus 1 according to the embodiment includes the image fixing unit 100 to fix the toner image on the sheet while transferring the sheet through the fixing nip. The image fixing unit 100 includes the first fixing section (the fixing roller 102 and the fixing belt 103) disposed adjacent to the first side with the unfixed toner image of the sheet, the first heating section (the heating roller 101) to heat the first fixing section, the second fixing section (the pressure roller 104) disposed adjacent to the second side opposite to the first side of the sheet, and the second heating section (the pressure roller 104) to heat the second fixing section. The image forming apparatus 1 also includes the sheet feeding trays 19*a* to 19*c* holding sheets, the storage unit 11 storing the fixing temperatures of the first and second fixing sections preset for each type of the sheets stocked in the sheet feeding trays, and the controller 10 to select appropriate standby temperatures of the first and second fixing sections from the fixing temperatures preset for each type of the sheets and stored in the storage unit 11, based on the temperature profiles of the first and second fixing sections, and to instruct the first and second heating sections to respectively maintain the first and second fixing sections at the selected standby temperatures during the standby mode before the image formation.

Such an image forming apparatus 1 can rapidly shift from the standby mode to the starting mode for the image formation with a reduced waiting time. The reduced waiting time before the start of the image formation can improve productivity.

The controller 10 according to the embodiment selects the maximum fixing temperature as a standby temperature of one of the first fixing section and the second fixing section that has a relatively high cooling rate, and the minimum fixing temperature as a standby temperature of the other fixing section, from the fixing temperatures preset for each type of the sheets and stored in the storage unit 11.

In detail, the first fixing section includes the fixing belt 103 and the cooling mechanism 105 to cool the fixing belt 103. The second fixing section includes the pressure roller 104 covered with an elastic material, for example. The controller 10 selects the maximum fixing temperature as a standby temperature of the first fixing section, and the minimum fixing temperature as a standby temperature of the second fixing section, from the fixing temperatures preset for each type of the sheets and stored in the storage unit 11.

Thus, the fixing section maintained at a high temperature during the standby mode rapidly cools, whereas the fixing unit maintained at a low temperature during the standby mode rapidly heats. Such a configuration can reduce the waiting time before the start of the image formation.

According to the embodiment described above, the temperature profiles of the first and second fixing sections are determined in the state where the first fixing section is separated from the second fixing section.

The use of such temperature profiles leads to more accurate temperature control.

According to the embodiment described above, the controller 10 updates the standby temperatures at predetermined time intervals before the image formation or in response to a request signal.

Such update of the standby temperatures leads to more accurate temperature control.

[Modification 1]

Modification 1 of the embodiment will now be described. The same components as those of the embodiment described above are designated with the same reference numerals without redundant description.

An image forming apparatus according to Modification 1 includes an image fixing unit 100, which is the same as the embodiment described above. A halogen heater H1 functioning as a main heater is disposed adjacent to the first or upper side of a sheet, and a halogen heater H2 functioning as an auxiliary heater is disposed adjacent to the lower side of the sheet without an image.

In Modification 1, a fixing belt 103 having small thermal capacity is disposed adjacent to the first or upper side of the sheet. The main halogen heater H1 in the heating roller 101 consumes high electric power.

In addition, a pressure roller 104 having large thermal capacity is disposed adjacent to the second or lower side of the sheet. The pressure roller 104 is provided with an elastic layer having low thermal conductivity. The auxiliary halogen heater H2 in the pressure roller 104 consumes low electric power.

A controller 10 accordingly determines the temperature profiles as follows: the first or upper side of the sheet has a heating rate higher than that of the second or lower side of the sheet.

The controller 10, therefore, allows the first fixing section adjacent to the first or upper side of the sheet to have a minimum fixing temperature "148° C.", and the second fixing section adjacent to the second or lower side of the sheet to have a maximum fixing temperature "140° C." during a standby mode.

In other words, the minimum fixing temperature is defined as standby temperatures of the fixing components (i.e., the fixing roller 102 and the fixing belt 103) disposed adjacent to the first or upper side of the sheet and having a high heating rate.

In contrast, the maximum fixing temperature is defined as a standby temperature of the fixing component (i.e., the pressure roller 104) disposed adjacent to the second or lower side of the sheet and having a low heating rate.

Thus, the fixing roller 102 and the fixing belt 103 that are maintained at a low temperature during the standby mode rapidly heat, while the pressure roller 104 maintained at a high temperature during the standby mode rapidly cools, leading to a reduction in waiting time before the start of the image formation.

As described above, the controller 10 according to Modification 1 selects the minimum fixing temperature as a standby temperature of any one of the first fixing section and the second fixing section that has a relatively high heating rate, and the maximum fixing temperature as a standby temperature of the other fixing section, from the fixing temperatures preset for each type of the sheets and stored in the storage unit 11.

In detail, the first fixing section includes the fixing belt 103, and the second fixing section includes the pressure roller 104 covered with an elastic material, for example. The first heating section consumes greater electric power than the second heating section. The controller 10 selects the minimum fixing temperature as a standby temperature of the first fixing section, and the maximum fixing temperature as a standby temperature of the second fixing section, from the fixing temperatures preset for each type of the sheets and stored in the storage unit 11.

Thus, the fixing section maintained at a low temperature during the standby mode rapidly heats, whereas the fixing section maintained at a high temperature during the standby mode rapidly cools, leading to a reduction in waiting time before the start of the image formation.

[Modification 2]

Modification 2 of the embodiment will now be described.

Figure 5:
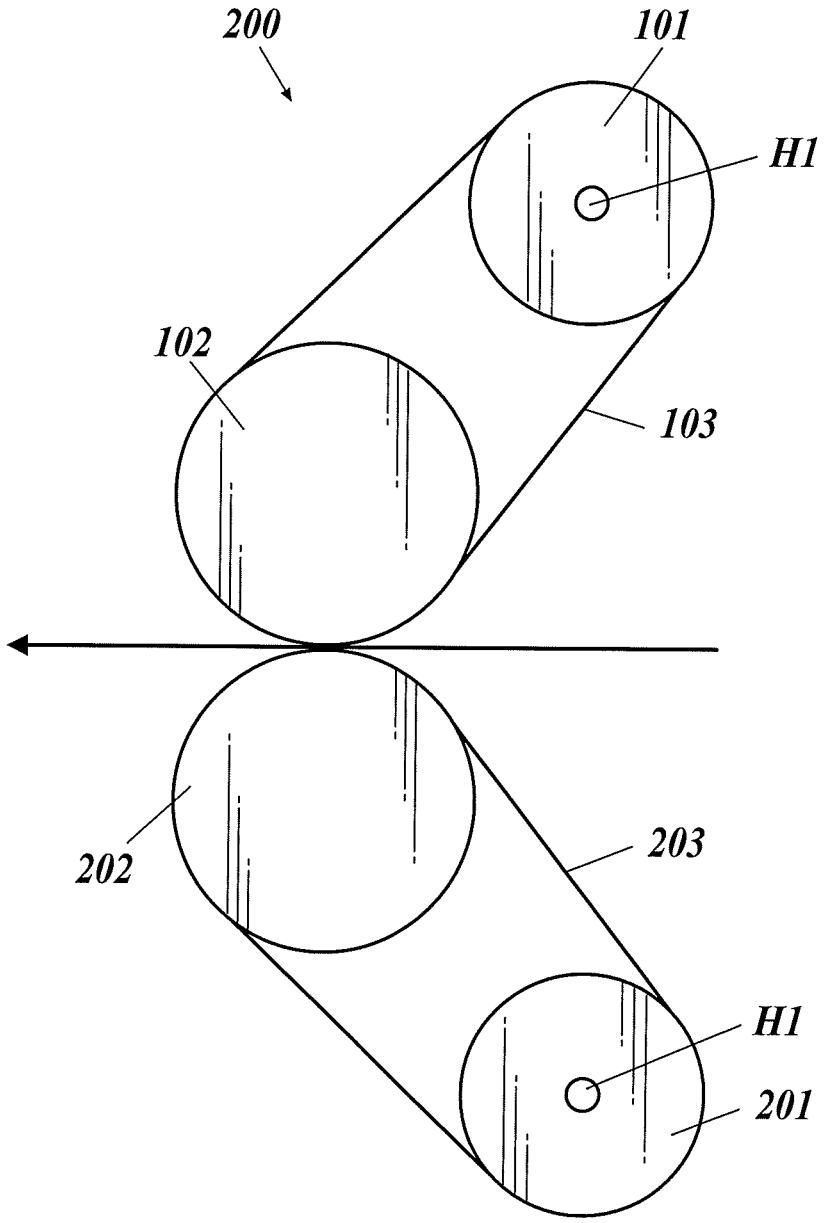
FIG. 5 is a schematic view of an image fixing unit according to a modification.

FIG. 5 is a schematic view of an image fixing unit 200 according to Modification 2.

With reference to FIG. 5, the image fixing unit 200 is provided with a heating roller 201, a pressure roller 202, and a fixing belt 203 that are adjacent to the second or lower side of the sheet, in place of the pressure roller 104 illustrated in FIG. 3.

The heating roller 201 has the same structure as the heating roller 101.

The pressure roller 202 has the same structure as the pressure roller 104 except that the pressure roller 202 does not accommodate a halogen heater H2.

The fixing belt 203, which has the same structure as a fixing belt 103, is rotatably supported by the heating roller 201 and the pressure roller 202.

Also in Modification 2, the setting table illustrated in FIG. 4 is stored in a storage unit 11.

In the image fixing unit 200 according to Modification 2, both a first heater adjacent to the first or upper side of the sheet and a second heater adjacent to the lower side of the sheet without an image function as main heaters.

In this case, both the fixing belt 103 adjacent to the first or upper side of the sheet and the fixing belt 203 adjacent to the lower side of the sheet without an image have small thermal capacity. The fixing belts 103 and 203 consume a large electric power at the same level.

The controller 10 accordingly determines that the heating rate is higher than the cooling rate in both the first or upper side of the sheet and the second or lower side of the sheet.

The controller 10, therefore, allows the first fixing section adjacent to the first or upper side of the sheet to have a minimum fixing temperature "148° C.", and the second fixing section adjacent to the second or lower side of the sheet to have a minimum fixing temperature "70° C." during a standby mode.

In other words, the minimum fixing temperatures are defined as standby temperatures of the first and second fixing sections respectively facing the first and second sides of the sheet.

Such a configuration allows the fixing roller 102, the fixing belt 103, the pressure roller 202, and the fixing belt 203 that are maintained at a low temperature during the standby mode to be rapidly heated, leading to a reduction in waiting time before the start of the image formation.

In the case that the heating rate is higher than the cooling rate in both the first and second fixing sections, the controller 10 according to Modification 2 selects the minimum fixing temperatures as standby temperatures of the first and second fixing sections, from the fixing temperatures preset for each type of the sheets and stored in the storage unit 11.

Such a configuration allows the first and second fixing sections maintained at a low temperature during the standby mode to be rapidly heated, leading to a reduction in waiting time before the start of the image formation.

[Modification 3]

Modification 3 of the embodiment will now be described.

Figure 6:
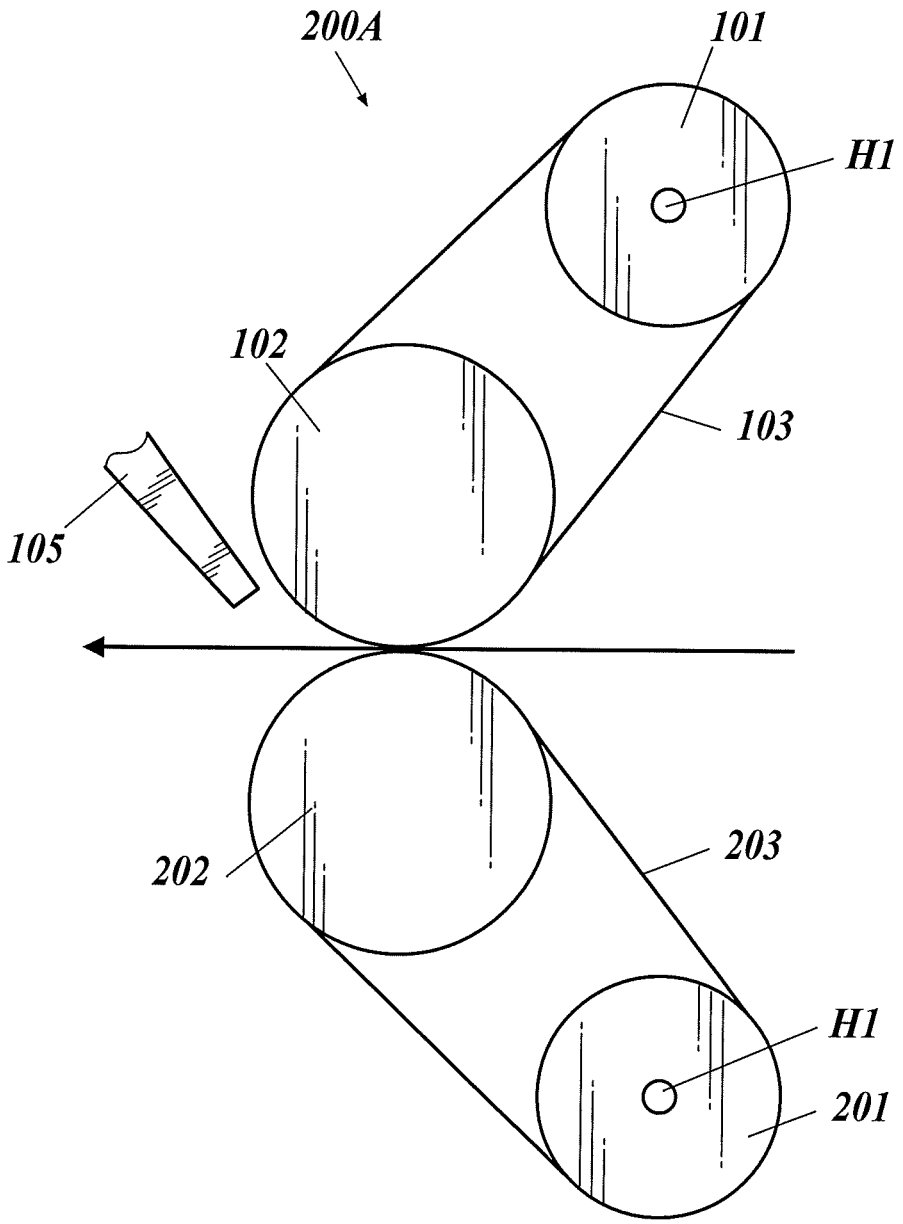
FIG. 6 is a schematic view of an image fixing unit according to another modification.

FIG. 6 is a schematic view of an image fixing unit 200A according to Modification 3.

With reference to FIG. 6, the image fixing unit 200A according to Modification 3 has the same configuration as the image fixing unit 200 according to Modification 2 except that the image fixing unit 200A also includes a cooling mechanism 105 disposed adjacent to the first or upper side of the sheet.

The image fixing unit 200A according to Modification 3 is provided with a fixing belt 103 having small thermal capacity and the cooling mechanism 105 that are disposed adjacent to the first or upper side of the sheet.

A fixing belt 203 having small thermal capacity is also disposed adjacent to the second or lower side of the sheet.

A controller 10 accordingly determines that the cooling rate is higher than the heating rate in both the first or upper side of the sheet and the lower side of the sheet without an image.

The controller 10, therefore, allows the first fixing section adjacent to the first or upper side of the sheet to have a maximum fixing temperature "192° C.", and the second fixing section adjacent to the second or lower side of the sheet to have a maximum fixing temperature "140° C." during a standby mode.

In other words, the maximum fixing temperatures are defined as standby temperatures of the first and second fixing sections respectively facing the first and second sides of the sheet.

Such a configuration allows the fixing roller 102, the fixing belt 103, the pressure roller 202, and the fixing belt 203 that are maintained at a high temperature during the standby mode to be rapidly cooled, leading to a reduction in waiting time before the start of the image formation.

In the case that the cooling rate is higher than the heating rate in both the first and second fixing sections, the controller 10 according to Modification 3 selects the maximum fixing temperatures as standby temperatures of the first and second fixing sections, from the fixing temperatures preset for each type of the sheets and stored in the storage unit 11.

Such a configuration allows the first and second fixing sections that are maintained at a high temperature during the standby mode to be rapidly cooled, leading to a reduction in waiting time before the start of the image formation.

[Modification 4]

In the embodiment and Modifications 1 to 3, an appropriate temperature is selected as a standby temperature from the fixing temperatures preset for each type of the sheets and stored in the storage unit 11. Alternatively, the mean temperature of the fixing temperatures preset for all the types of the sheets and stored in the storage unit 11 may be defined as a standby temperature.

For example, in the case that the heating rate is comparable with the cooling rate in both the first and second fixing sections, the controller 10 may define the mean temperature of the upper-side fixing temperatures and the mean temperature of the lower-side fixing temperatures preset for all the types of the sheets and stored in the storage unit 11 as the standby temperatures of the first and second fixing sections, respectively.

In detail, the controller 10 may define the mean temperatures as standby temperatures, for example, under the following conditions: the time until the leading edge of a sheet fed from any of the sheet feeding trays 19*a* to 19*c* reaches the image fixing unit 100 is two seconds (2 s); both the heating rate and the cooling rate of the fixing sections are approximately 5° C./s; and the difference between the maximum and minimum upper-side fixing temperatures and the difference between the maximum and minimum lower-side fixing temperatures preset for a sheet feeding trays are not greater than 20° C. (=5° C./s×2 s×2), respectively, where the constant "2" represents the directions of the temperature variation (i.e., temperature rise and temperature drop).

Such a configuration can reduce the waiting time on the whole regardless of the type of a subsequent sheet.

In the case that the time until the image fixing unit 100 reaches a predetermined temperature is not greater than the time until the leading edge of the sheet fed from any of the sheet feeding trays 19*a* to 19*c* reaches the image fixing unit 100, the controller 10 may determine the standby temperatures based on the difference between the upper-side fixing temperature and the lower-side fixing temperature preset for each sheet feeding trays 19*a* to 19*c*.

For example, the controller 10 can define the minimum fixing temperatures as standby temperatures, for example, under the following conditions: the time until the leading edge of a sheet fed from any of the sheet feeding trays 19*a* to 19*c* reaches the image fixing unit 100 is two seconds (2 s); the heating rates of the first and second fixing section are respectively 5° C./s; and the difference between the maximum and minimum upper-side fixing temperatures and the difference between the maximum and minimum lower-side fixing temperature preset for a sheet feeding tray are not greater than 10° C. (=5° C./s×2 s), respectively.

It should be noted that detailed configurations of the embodiments described above can be appropriately modified within the scope of the present invention.

For example, the controller 10 can modify the temperature profiles depending on the warm-up state and the environmental condition of the image forming apparatus 1 to determine the standby temperature.

In detail, the heating rate and the cooling rate at an environmental air temperature of 10° C. are different from those at an environmental air temperature of 20° C. To address the problem, the image forming apparatus 1 includes a temperature sensor to detect the environmental temperature, for example. The controller 10 determines whether the heating rate and the cooling rate in the environmental condition detected at the temperature sensor are greater than those in an ordinary environmental condition.

Such a configuration leads to accurate temperature control in view of the environmental condition of the image forming apparatus 1.

The image forming apparatus 1 may also include detectors 20 to detect the types of the sheets stocked in the sheet feeding trays 19*a* to 19*c*. In the case that the type of the sheet detected at any of the detectors 20 differs from the type of the sheets preset for the sheet feeding trays 19*a* to 19*c*, the controller 10 overwrites the fixing temperatures stored in the setting table T1 with the fixing temperatures for the sheet detected at the detector 20 stored in the reference table T2. The detectors 20 may be roughness testers or weight scales that are disposed in the sheet feeding trays 19*a* to 19*c*.

In this case, the controller 10 acquires the fixing temperatures preset for the type of the sheet detected at the detector 20 in reference to the reference table T2, and then overwrites the setting table T1 with the acquired fixing temperatures.

Such a configuration can replace the parameters for the sheets in the sheet feeding trays 19*a* to 19*c* stored in the setting table with the parameters for the sheet currently set, leading to accurate temperature control.

In another embodiment, the controller 10 controls the temperature of the image fixing unit after any image processing operation scheduled at the start of the image formation.

Such a configuration leads to more efficient temperature

In still another embodiment, the storage unit 11 may include a sheet proportion storage which stores the accumulated proportion of the different types of the sheets used for the past image formation. In this embodiment, the controller 10 may allow the fixing temperatures preset for each type of the sheets and stored in the setting table T1 to be weighted with the accumulated proportion stored in the storage unit 11.

Such a configuration leads to more accurate temperature control.

If a user changes the setting of a sheet without detachment of any of the sheet feeding trays 19*a* to 19*c*, the temperature control is preferably conducted based on the fixing temperatures of the sheet set by the user. Such a user's intended operation can prevent deterioration of fixing properties due to the physical properties of the sheet, such as the roughness of the surface of the sheet, other than the size and weight of the sheet.

The first and second fixing sections may have any configuration other than those described above and may be appropriately modified.

This application is based on Japanese Patent Application No. 2016-123135 filed on Jun. 22, 2016 with Japan Patent Office, the entire content of which is hereby incorporated by reference.

What is claimed is:

1. An image forming apparatus comprising:

an image fixing unit to pass a sheet carrying an unfixed toner image on a first side through a fixing nip to fix the unfixed toner image on the sheet, the image fixing unit comprising:

a first fixing section disposed to be adjacent to the first side of the sheet;

a first heating section to heat the first fixing section;

a second fixing section disposed to be adjacent to a second side opposite to the first side of the sheet; and a second heating section to heat the second fixing section;

a plurality of sheet feeding trays holding sheets;

a storage unit storing fixing temperatures of the first fixing section and the second fixing section, the fixing temperatures being preset for each type of the sheets in the sheet feeding trays; and a controller (i) to select standby temperatures of the first fixing section and the second fixing section from the fixing temperatures preset for each type of the sheets and stored in the storage unit, based on temperature profiles of the first fixing section and the second fixing section, wherein the standby temperatures are based on a relative heating rate or a relative cooling rate of the first fixing section and the second fixing section, and (ii) to instruct the first heating section and the second heating section to respectively maintain the first fixing section and the second fixing section at the selected standby temperatures during a standby mode before image formation.

2. The image forming apparatus according to claim 1, wherein the controller selects a maximum fixing temperature as the standby temperature of one of the first fixing section and the second fixing section that has a relatively high cooling rate, and a minimum fixing temperature as the standby temperature of the other fixing section, from the fixing temperatures preset for each type of the sheets and stored in the storage unit.

3. The image forming apparatus according to claim 2, wherein the first fixing section comprises a belt member and a cooling mechanism to cool the belt member, the second fixing section comprises a rotary member covered with an elastic material, and the controller selects a maximum fixing temperature as the standby temperature of the first fixing section and a minimum fixing temperature as the standby temperature of the second fixing section, from the fixing temperatures preset for each type of the sheets and stored in the storage unit.

4. The image forming apparatus according to claim 1, wherein the controller selects a minimum fixing temperature as the standby temperature of one of the first fixing section and the second fixing section that has a relatively high heating rate, and a maximum fixing temperature as the standby temperature of the other fixing section, from the fixing temperatures preset for each type of the sheets and stored in the storage unit.

5. The image forming apparatus according to claim 4, wherein the first fixing section comprises a belt member, the second fixing section comprises a rotary member covered with an elastic material, the first heating section consumes greater electric power than the second heating section, and the controller selects a minimum fixing temperature as the standby temperature of the first fixing section, and a maximum fixing temperature as the standby temperature of the second fixing section, from the fixing temperatures preset for each type of the sheets and stored in the storage unit.

6. The image forming apparatus according to claim 1, wherein in the case that a heating rate is higher than a cooling rate in both the first fixing section and the second fixing section, the controller selects minimum fixing temperatures as the standby temperatures of the first fixing section and the second fixing section, from the fixing temperatures preset for each type of the sheets and stored in the storage unit.

7. The image forming apparatus according to claim 1, wherein in the case that a cooling rate is higher than a heating rate in both the first fixing section and the second fixing section, the controller selects maximum fixing temperatures as the standby temperatures of the first fixing section and the second fixing section, from the fixing temperatures preset for each type of the sheets and stored in the storage unit.

8. The image forming apparatus according to claim 1, wherein in the case that a cooling rate is comparable with a heating rate in both the first fixing section and the second fixing section, the controller defines mean temperatures of the fixing temperatures preset for all the types of the sheets and stored in the storage unit as the standby temperatures of the first fixing section and the second fixing section.

9. The image forming apparatus according to claim 1, wherein the temperature profiles are determined in the state where the first fixing section is separated from the second fixing section.

10. The image forming apparatus according to claim 1, wherein the controller modifies the temperature profiles depending on a warm-up state or an environmental condition of the image forming apparatus.

11. The image forming apparatus according to claim 1, further comprising: a correspondence information storage preliminary storing a correlation between the type of sheets and the fixing temperatures of the first fixing section and the second fixing section; and detectors to detect the types of sheets stocked in the sheet feeding trays, wherein in the case that a sheet detected at any of the detectors differs in type from the sheets stocked in the sheet feeding trays, the controller overwrites the fixing temperatures stored in the storage unit with the fixing temperatures stored in the correspondence information storage.

12. The image forming apparatus according to claim 1, wherein the controller updates the standby temperatures at predetermined time intervals before image formation or in response to a request signal.

13. The image forming apparatus according to claim 1, wherein in the case that any image processing operation other than temperature control of the image fixing section is scheduled at the start of the image formation, the controller controls the temperature of the image fixing unit after the image processing operation.

14. The image forming apparatus according to claim 1, further comprising: a sheet proportion storage which stores an accumulated proportion of different types of sheets used for past image formation, wherein the controller allows the fixing temperatures preset for each type of the sheets and stored in the storage unit to be weighted with the accumulated proportion stored in the sheet proportion storage.

* * * * *